US011536187B2

(12) United States Patent
Lopez et al.

(10) Patent No.: US 11,536,187 B2
(45) Date of Patent: Dec. 27, 2022

(54) SYSTEMS AND METHODS FOR CONTROLLING COOLANT AND FUEL ENRICHMENT

(71) Applicant: GM GLOBAL TECHNOLOGY OPERATIONS LLC, Detroit, MI (US)

(72) Inventors: Richard J. Lopez, Bloomfield, MI (US); Michael A. Smith, Clarkston, MI (US); Eugene V. Gonze, Pickney, MI (US); David E. Edwards, Rochester Hills, MI (US); Michael J. Paratore, Jr., Howell, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 56 days.

(21) Appl. No.: 17/032,924

(22) Filed: Sep. 25, 2020

(65) Prior Publication Data

US 2022/0099014 A1 Mar. 31, 2022

(51) Int. Cl.

| | |
|---|---|
| ***F01P 3/02*** | (2006.01) |
| ***F01P 7/16*** | (2006.01) |
| ***F02D 1/02*** | (2006.01) |
| ***F02D 1/00*** | (2006.01) |

(52) U.S. Cl.

CPC ..... *F01P 3/02* (2013.01); *F01P 7/164* (2013.01); *F01P 7/165* (2013.01); *F02D 1/025* (2013.01); *F01P 2003/027* (2013.01); *F02D 2001/0075* (2013.01)

(58) Field of Classification Search

CPC .... F01P 3/02; F01P 7/164; F01P 7/165; F01P 2003/027; F02D 1/025; F02D 2001/0075

See application file for complete search history.

(56) References Cited

U.S. PATENT DOCUMENTS

| | | | | |
|---|---|---|---|---|
| 10,161,501 | B2 * | 12/2018 | Gonze | B60H 1/04 |
| 10,669,922 | B2 * | 6/2020 | Gonze | F01P 5/10 |
| 2008/0201034 | A1 * | 8/2008 | Eiraku | F02D 41/221 701/104 |
| 2012/0137993 | A1 * | 6/2012 | Kim | F01P 7/165 123/41.11 |
| 2013/0305708 | A1 * | 11/2013 | Zahdeh | F01P 3/20 60/599 |
| 2016/0146092 | A1 * | 5/2016 | Lee | F01P 7/16 123/41.1 |
| 2017/0159546 | A1 * | 6/2017 | Gonze | F01P 7/164 |
| 2017/0321594 | A1 * | 11/2017 | Gonze | F01P 3/12 |
| 2017/0356327 | A1 * | 12/2017 | Gonze | F01P 7/164 |
| 2018/0320617 | A1 * | 11/2018 | Ahmed | F01N 3/043 |
| 2018/0371982 | A1 * | 12/2018 | Bilancia | F02M 26/28 |
| 2022/0099014 | A1 * | 3/2022 | Lopez | F01P 3/02 |

* cited by examiner

*Primary Examiner* — Kurt Philip Liethen

(57) ABSTRACT

An engine control system for an engine includes: a pump control module configured to control a coolant pump; a block control module configured to control opening of a block valve; a fuel control module configured to control fueling of the engine; a coolant control module configured to control a position of a coolant valve; and an adjustment module configured to, when the coolant pump is pumping, the block valve is open, and the coolant valve is positioned such that an input is connected to an output, adjust the fueling of the engine such that fueling of the engine is fuel rich.

19 Claims, 3 Drawing Sheets

SYSTEMS AND METHODS FOR CONTROLLING COOLANT AND FUEL ENRICHMENT

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to vehicles with internal combustion engines and more particularly to systems and methods for controlling engine coolant flow and fueling of the engine.

An internal combustion engine combusts air and fuel within cylinders to generate drive torque. Combustion of air and fuel also generates heat and exhaust. Exhaust produced by an engine flows through an exhaust system before being expelled to atmosphere.

Excessive heating may shorten the lifetime of the engine, engine components, and/or other components of a vehicle. As such, vehicles that include an internal combustion engine include a radiator that is connected to coolant channels within the engine. Engine coolant circulates through the coolant channels and the radiator. The engine coolant absorbs heat from the engine and carries the heat to the radiator. The radiator transfers heat from the engine coolant to air passing the radiator. The cooled engine coolant exiting the radiator is circulated back to the engine.

SUMMARY

In a feature, an engine control system for an engine includes: a pump control module configured to control application of power to an electric coolant pump based on a target speed; a block control module configured to control opening of a block valve, where the block valve is configured to block coolant flow through a block portion of the engine when the block valve is closed and to allow coolant flow through the block portion of the engine when the block valve is open; a fuel control module configured to control fueling of the engine; a coolant control module configured to control a position of a coolant valve, where the coolant valve has a first input that receives coolant after the coolant flows through the engine, a second input that receives coolant directly from the electric coolant pump, and an output that is connected to at least one of an engine oil heat exchanger and a transmission oil heat exchanger; and an adjustment module configured to, after the target speed of the electric coolant pump is set to a predetermined maximum speed, the block valve is open, and the coolant valve is positioned such that the second input is connected to the output, adjust the fueling of the engine such that fueling of the engine is fuel rich.

In further features, the adjustment module is configured to open the block valve after the target speed is set to the predetermined maximum speed when a temperature of the block portion of the engine is one of greater than and equal to a predetermined maximum block temperature.

In further features, the adjustment module is configured to position the coolant valve such that the second input is connected to the output after the block valve is open when an engine oil temperature is one of greater than and equal to a predetermined maximum oil temperature.

In further features, the adjustment module is configured to adjust the fueling of the engine such that fueling of the engine is fuel rich after the coolant valve is positioned such that the second input is connected to the output when a temperature of cylinder walls of the engine is one of greater than and equal to a predetermined maximum wall temperature.

In further features, a block temperature module is configured to determine the temperature of the block portion of the engine based a temperature of coolant output from the block portion of the engine.

In further features, a temperature sensor is configured to measure the engine oil temperature.

In further features, a wall temperature module is configured to determine the temperature of the cylinder walls of the engine based on a temperature of coolant output from a head portion of the engine.

In further features: the fuel control module is configured to control the fueling of the engine based on a target lambda value; and the adjustment module is configured to adjust the target lambda value to less than 1.0 after the target speed of the electric coolant pump is set to the predetermined maximum speed, the block valve is open, and the coolant valve is positioned such that the second input is connected to the output.

In further features, the output of the coolant valve is connected to both of the engine oil heat exchanger and the transmission oil heat exchanger.

In further features, the first input of the coolant valve receives coolant output from the block portion of the engine.

In further features, the first input of the coolant valve receives coolant output from a head portion of the engine.

In further features, the first input of the coolant valve receives coolant output from an integrated exhaust manifold of the engine.

In further features, the first input of the coolant valve receives coolant output from a turbine of a turbocharger of the engine.

In further features, the electric coolant pump is configured to output coolant to: the block portion of the engine; a head portion of the engine; an integrated exhaust manifold of the engine; and a turbine of a turbocharger of the engine.

In a feature, an engine control system for an engine includes: a pump control module configured to control engagement and disengagement of a coolant pump; a block control module configured to control opening of a block valve, where the block valve is configured to block coolant flow through a block portion of the engine when the block valve is closed and to allow coolant flow through the block portion of the engine when the block valve is open; a fuel control module configured to control fueling of the engine; a coolant control module configured to control a position of a coolant valve, where the coolant valve has a first input that receives coolant after the coolant flows through the engine, a second input that receives coolant directly from the coolant pump, and an output that is connected to at least one of an engine oil heat exchanger and a transmission oil heat exchanger; and an adjustment module configured to, when the coolant pump is engaged, the block valve is open, and the coolant valve is positioned such that the second input is connected to the output, adjust the fueling of the engine such that fueling of the engine is fuel rich.

In a feature, an engine control method for an engine includes: controlling application of power to an electric coolant pump based on a target speed; controlling opening of a block valve, where the block valve is configured to block coolant flow through a block portion of the engine when the block valve is closed and to allow coolant flow through the block portion of the engine when the block valve is open; controlling fueling of the engine; controlling a position of a coolant valve, where the coolant valve has a first input that receives coolant after the coolant flows through the engine, a second input that receives coolant directly from the electric coolant pump, and an output that is connected to at least one of an engine oil heat exchanger and a transmission oil heat exchanger; and after the target speed of the electric coolant pump is set to a predetermined maximum speed, the block valve is open, and the coolant valve is positioned such that the second input is connected to the output, adjusting the fueling of the engine such that fueling of the engine is fuel rich.

In further features, the engine control method further incudes opening the block valve after the target speed is set to the predetermined maximum speed when a temperature of the block portion of the engine is one of greater than and equal to a predetermined maximum block temperature.

In further features, the engine control method further incudes positioning the coolant valve such that the second input is connected to the output after the block valve is open when an engine oil temperature is one of greater than and equal to a predetermined maximum oil temperature.

In further features, the adjusting the fueling includes adjusting the fueling of the engine such that fueling of the engine is fuel rich after the coolant valve is positioned such that the second input is connected to the output when a temperature of cylinder walls of the engine is one of greater than and equal to a predetermined maximum wall temperature.

In further features, the engine control method further incudes determining the temperature of the block portion of the engine based a temperature of coolant output from the block portion of the engine.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

and

Figure 3:
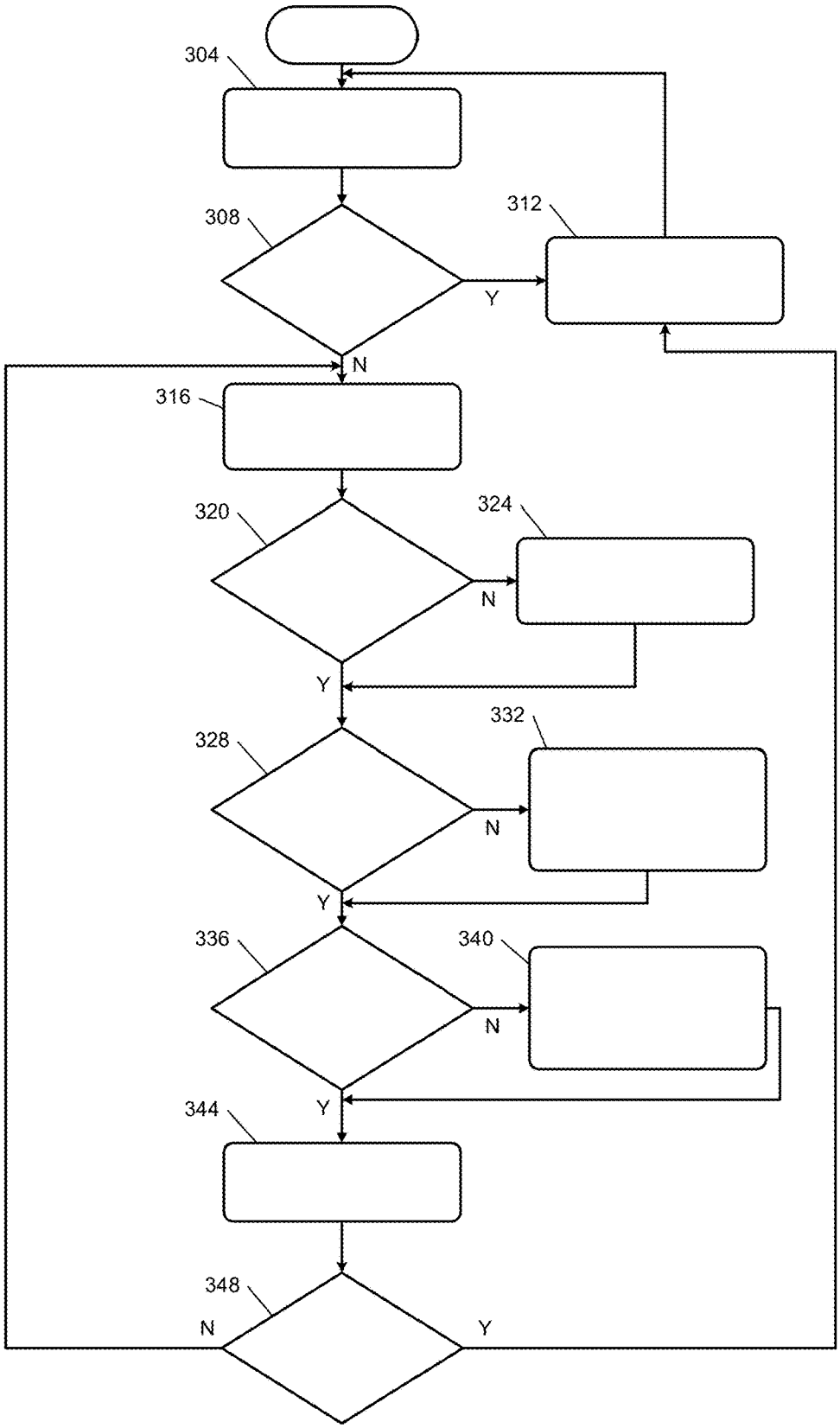

FIG. 3 is a flowchart depicting an example method of controlling coolant flow and fueling.

In the drawings, reference numbers may be reused to identify similar and/or identical elements.

DETAILED DESCRIPTION

An engine combusts air and fuel to generate drive torque. A coolant system includes a coolant pump that circulates coolant through various portions of the engine, such as a cylinder head, an engine block, and an integrated exhaust manifold (IEM). The engine coolant is used to absorb heat from the engine, engine oil, transmission fluid, and other components and to transfer heat to air via one or more heat exchangers.

According to the present application, when a target output of the coolant pump reaches a predetermined maximum output, a control module first opens a block valve when a temperature of a block of the engine reaches a predetermined block temperature. The block valve allows coolant flow through a block of the engine when the block valve is open, thereby cooling the engine.

Second, when an engine oil temperature reaches a predetermined maximum oil temperature after the opening of the block valve, the control module opens a coolant valve to flow coolant from the coolant pump to at least one of an engine oil and a transmission oil heat exchanger (without traveling through the engine) for cooling. Third, when a temperature of cylinder walls of the engine reaches a predetermined maximum wall temperature after the opening of the coolant valve, the control module provides fuel rich fueling to the engine. The fuel rich fueling cools the engine. In this manner, fuel rich fueling is only provided to the engine after the block valve is opened and the cooling is performed via the engine and/or transmission oil heat exchangers.

Figure 1:
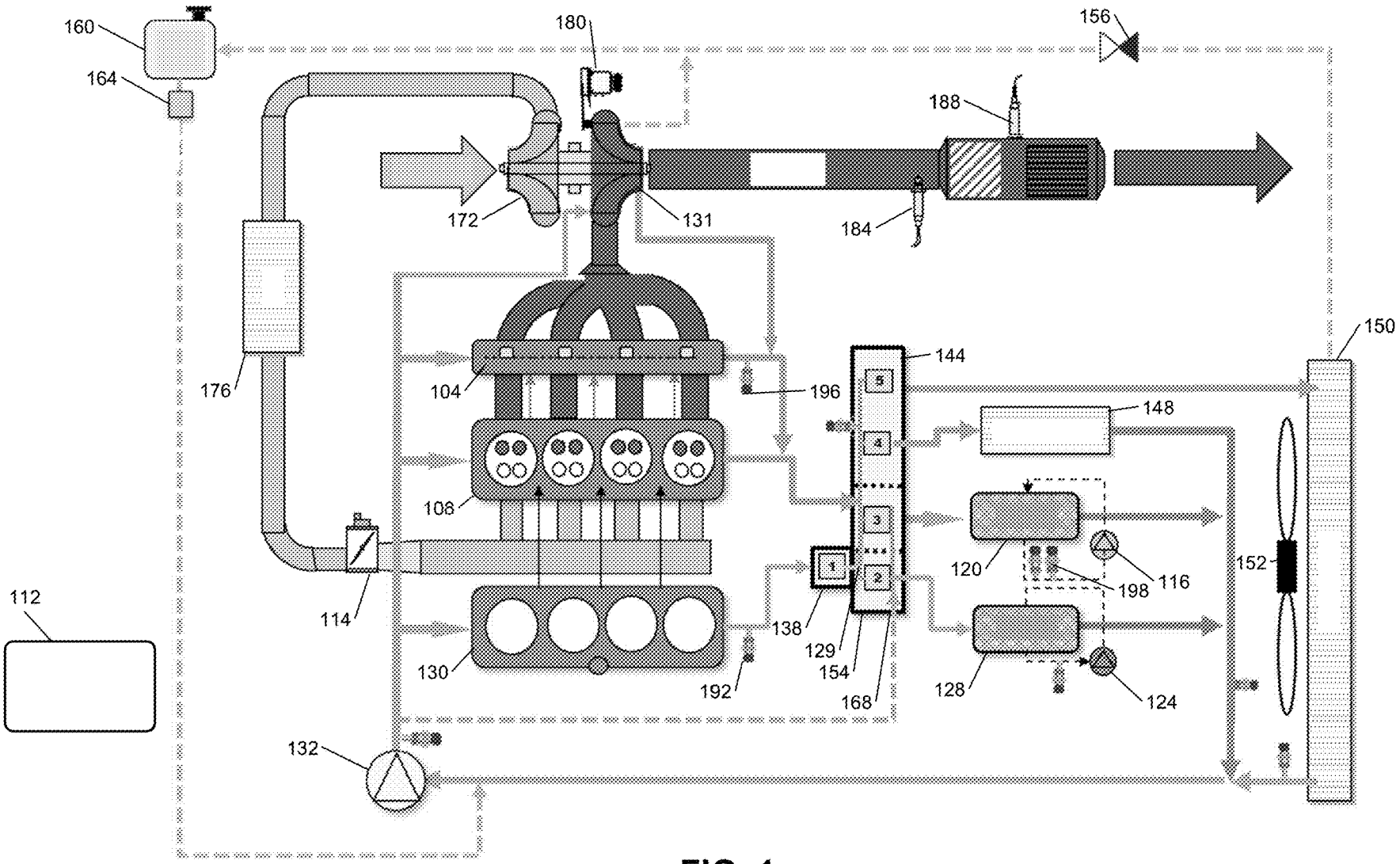
FIG. 1 is afunctional block diagram of an example engine and coolant system.

Referring now to FIG. 1, a functional block diagram of an example vehicle system is presented. An engine combusts a mixture of air and fuel within cylinders to generate drive torque. Fuel injectors may inject fuel, for example, directly into the cylinders. An integrated exhaust manifold (IEM) 104 receives exhaust output from the cylinders and is integrated with a portion of the engine, such as a head 108 of the engine.

The engine outputs torque to a transmission. The transmission transfers torque to one or more wheels of a vehicle via a driveline (not shown). An engine control module (ECM) 112 may control one or more engine actuators to regulate the torque output of the engine. For example, the ECM 112 may control fueling provided by the fuel injectors and airflow into the engine via, for example, a throttle valve 114.

An engine oil pump 116 circulates engine oil through the engine and a first heat exchanger 120. The first heat exchanger 120 may be referred to as an (engine) oil cooler or an engine oil heat exchanger (EOH). When the engine oil is cold, the first heat exchanger 120 may transfer heat to engine oil within the first heat exchanger 120 from coolant flowing through the first heat exchanger 120. The first heat exchanger 120 may transfer heat from the engine oil to coolant flowing through the first heat exchanger 120 and/or to air passing the first heat exchanger 120 when the engine oil is warm.

A transmission fluid pump 124 circulates transmission fluid through the transmission and a second heat exchanger 128. The second heat exchanger 128 may be referred to as a transmission cooler or as a transmission oil heat exchanger (TOH). When the transmission fluid is cold, the second heat exchanger 128 may transfer heat to transmission fluid within the second heat exchanger 128 from coolant flowing through the second heat exchanger 128. The second heat exchanger 128 may transfer heat from the transmission fluid to coolant flowing through the second heat exchanger 128 and/or to air passing the second heat exchanger 128 when the transmission fluid is warm.

The engine includes a plurality of channels through which engine coolant ("coolant") can flow. For example, the engine may include one or more channels through the head 108 of the engine, one or more channels through a block 130 of the engine, one or more channels through a turbine 131 of a turbocharger, and/or one or more channels through the IEM 106. The engine may also include one or more other suitable coolant channels.

When a coolant pump 132 is on (or engaged in the example of a mechanical coolant pump), the coolant pump 132 pumps coolant to the channels, such as through the block 130, the head 108, and the IEM 104. While the coolant pump 132 is shown and will be discussed as an electric coolant pump, the coolant pump 132 may alternatively be mechanically driven (e.g., by the engine) or another suitable type of variable output coolant pump. The ECM 112 controls the coolant pump 132, such as a speed of the coolant pump 132 in the example of an electrical coolant pump. The ECM 112 may control the speed of the coolant pump 132, for example, by controlling the application of power to the coolant pump 132. In the example of a mechanical pump, the ECM 112 may control engagement and disengagement of the coolant pump 132.

A block valve (BV) 138 receives coolant out from the block 130 of the engine. The ECM 112 regulates opening of the block valve 138 and therefore coolant flow through and output from the block 130 of the engine.

A first coolant valve 144 receives coolant output from the turbocharger turbine 131, the IEM 104, the head 108, and the block valve 138. The first coolant valve 144 regulates coolant flow to (and therefore through) a third heat exchanger 148 and a fourth heat exchanger 150. The first coolant valve 144 may be configured to output coolant only the third heat exchanger 148, only the fourth heat exchanger 150, neither the third heat exchanger 148 nor the fourth heat exchanger 150, or both of the third and fourth heat exchangers 148 and 150. The third heat exchanger 148 may also be referred to as a heater core. The fourth heat exchanger 150 may be referred to as a radiator. Air may be circulated past the third heat exchanger 148, for example, to warm a passenger cabin of the vehicle. The fourth heat exchanger 150 transfers heat to air passing the fourth heat exchanger 150. A cooling fan 152 may be implemented to increase airflow passing the fourth heat exchanger 150. The ECM 114 controls actuation of the first coolant valve 144 to control coolant flow to and through the third and fourth heat exchangers 148 and 150.

A second coolant valve 154 also receives coolant output from the turbocharger turbine 131, the IEM 104, the head 108, and the block valve 138 via an input 129. The second coolant valve 154 regulates coolant flow to (and therefore through) the first heat exchanger 120 and the second heat exchanger 128. The second coolant valve 154 may be configured to output coolant only the first heat exchanger 120, only the second heat exchanger 128, neither the first heat exchanger 120 nor the second heat exchanger 128, or both of the first and second heat exchangers 120 and 128. In various implementations, the first and second coolant valves 144 and 154 may be implemented together within one housing and collectively referred to as a coolant control valve. The ECM 114 controls actuation of the first coolant valve 144 to control coolant flow to and through the first and second heat exchangers 120 and 128.

Coolant output from the first heat exchanger 120, the second heat exchanger 128, the third heat exchanger 148, and the fourth heat exchanger 150 flow back to the coolant pump 132. In various implementations, a check valve 156, a surge tank 160, and an air separator 164 may be implemented.

The second coolant valve 154 may include an input 168 that is connected to receive coolant directly from the coolant pump 132. The coolant received at the input 168 is not warmed via traveling through one or more of the channels through the engine after being output by the coolant pump 132. The second coolant valve 154 may be configured to output coolant received at the input 168 to only the first heat exchanger 120, only the second heat exchanger 128, neither the first heat exchanger 120 nor the second heat exchanger 128, or both of the first and second heat exchangers 120 and 128.

Exhaust gas output by the engine drives rotation of the turbine 131 of the turbocharger. Rotation of the turbine 131 drives rotation of a compressor 172 of the turbocharger. The compressor 172 pumps air into the engine. An air cooler 176, such as a charge air cooler (CAC) or an intercooler, may cool the air flowing into the engine. A wastegate 180 may be implemented to allow exhaust to bypass the turbine 131.

An air fuel ratio, such as a lambda value, of the exhaust output from the engine may be measured using an air/fuel sensor 184, such as a wide range air fuel (WRAF) sensor. An amount of oxygen in the exhaust output from the engine may be measured using an oxygen sensor 188, such as a universal exhaust gas oxygen (UEGO) sensor. The ECM 112 may control fueling of the engine in closed loop based on measurements from the air/fuel sensor 184. For example, the ECM 112 may adjust fueling of the engine to adjust the lambda value measured by the air/fuel sensor 184 to a target lambda value. As discussed further below, the ECM 112 may adjust the target lambda value to less than 1.0 (to provide fuel rich fueling) under some circumstances. The ECM 112 may set the target lambda value to 1.0 (to provide stoichiometric fueling) for normal operation.

A block temperature sensor 192 measures a temperature of coolant output from the block 130. An IEM temperature sensor 196 measures a temperature of coolant output from the IEM 104. An oil temperature sensor 198 measures a temperature of the engine oil. The ECM 112 may control one or more actuators based on one or more measured and/or estimated parameters.

Figure 2:
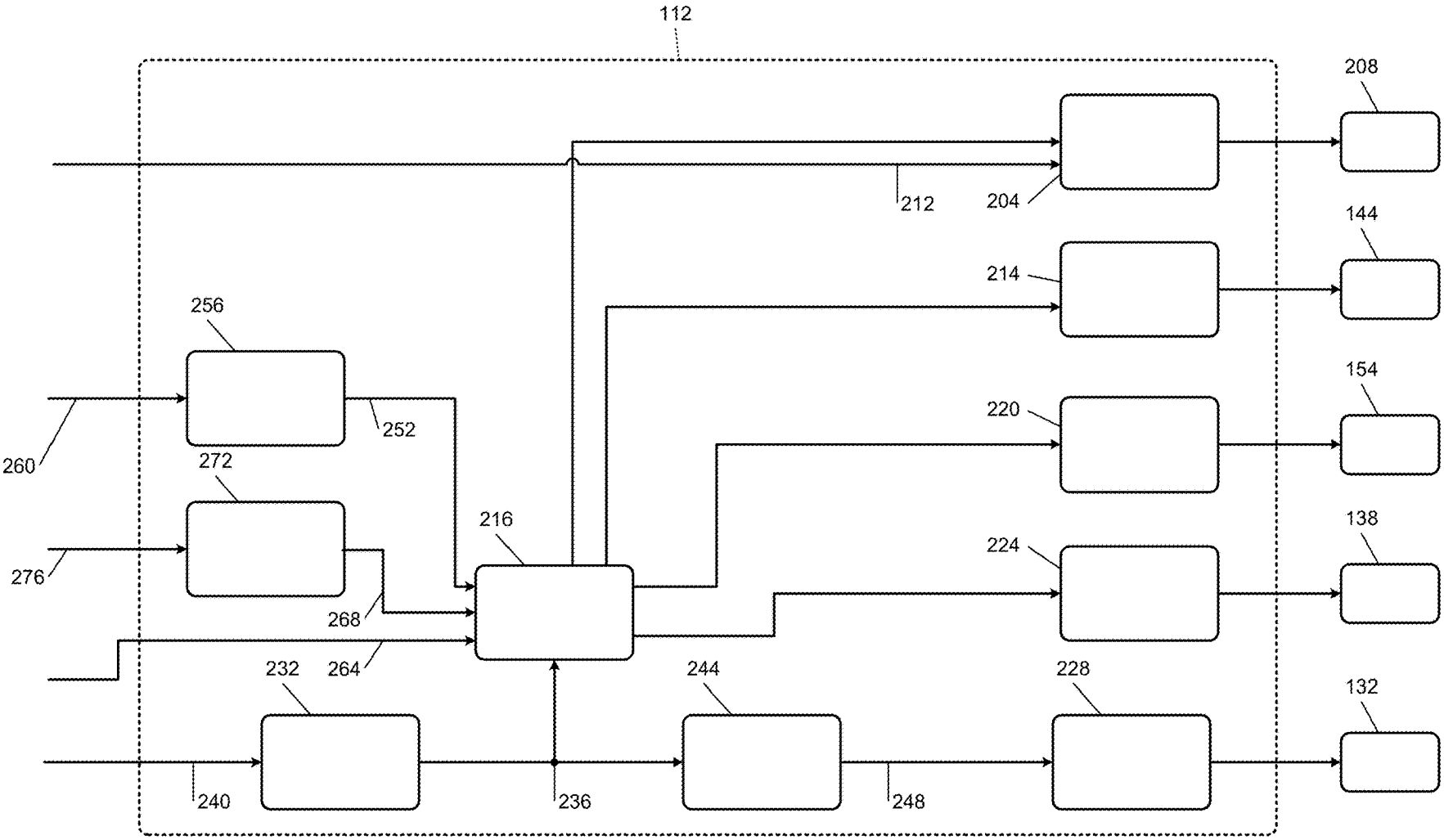
FIG. 2 is a functional block diagram of an example engine control module.

FIG. 2 is a functional block diagram of an example of the ECM 112. A fuel control module 204 controls fuel injection by fuel injectors 208 to the engine. For example, the fuel control module 204 may determine a target mass of fuel to inject for each cylinder based on a mass of air within that cylinder based on achieving a predetermined air to fuel ratio, such as a stoichiometric air to fuel ratio. The fuel control module 204 may adjust the target mass to adjust the lambda value 212 measured by the air/fuel sensor 184 toward a target lambda value. For example, the fuel control module 204 may decrease the target mass when the lambda value 212 is less than the target lambda value and increase the target mass when the lambda value 212 is greater than the target lambda value. The fuel control module 204 may control the fuel injectors 208 based on the target mass. The fuel control module 204 may determine a target mass for each combustion cycle of each cylinder.

The target lambda value may be set to 1.0 under normal conditions. As discussed further below, an adjustment module 216 may adjust the target lambda value to be less than 1 to provide fuel rich fueling to the engine under some conditions. The target lambda value may be adjusted to greater than 1 to provide fuel lean fueling to the engine.

A first coolant control module 214 actuates the first coolant valve 144. For example, the first coolant control module 214 may determine a first target position for the first coolant valve 144 and actuate the first coolant valve 144 to achieve the first target position.

A second coolant control module 220 actuates the second coolant valve 154. For example, the second coolant control module 220 may determine a second target position for the second coolant valve 154 and actuate the second coolant valve 154 to achieve the second target position.

A block valve control module 224 actuates the block valve 138. For example, the block valve control module 224 may determine a third target position for the block valve 138 and actuate the block valve 138 to achieve the third target position.

A pump control module 228 control the output of the coolant pump 132. For example, in the example of an electrical coolant pump, a target flowrate module 232 may determine a target flowrate 236 out of the coolant pump 132. The target flowrate module 232 may determine the target flowrate 236, for example, based on a present engine load 240 (a load of the engine). The target flowrate module 232 may determine the target flowrate 236, for example, using an equation or a lookup table that relates engine loads to target flowrates. The target flowrate module 232 limits the target flowrate 236 to being less than or equal to a predetermined maximum flowrate. The ECM 112 may determine the engine load 240, for example, based on a ratio of an intake manifold pressure of the engine to a maximum intake manifold pressure of the engine. The pump control module 228 may determine whether to engage or disengage (or a slip of a clutch) in the example of a mechanical coolant pump.

A target speed module 244 may determine a target speed 248 of the coolant pump 132 to achieve the target flowrate 236. For example, the target speed module 244 may determine the target speed 248 based on the target flowrate 236 using an equation or a lookup table that relates target flowrates to target speeds. The pump control module 228 may apply power (e.g., from a battery) to the coolant pump 132 to achieve the target speed 248. For example, the pump control module 228 may determine a pulse width modulation (PWM) duty cycle to apply to the coolant pump 132 to achieve the target speed 248 and apply power to the coolant pump 132 at the PWM duty cycle. The pump control module 228 may determine the PWM duty cycle using one of an equation and a lookup table that relates target speeds to PWM duty cycles.

The adjustment module 216 selectively adjusts one or more actuators when the target flowrate 236 reaches the predetermined maximum flowrate. For example, when a block temperature 252 of the block 130 of the engine reaches a predetermined maximum block temperature, the adjustment module 216 opens the block valve 138 via the block valve control module 224. The block temperature 252 may be measured using a temperature sensor within the block 130 of the engine. Alternatively, a block temperature module 256 may determine the block temperature 252 based on one or more other parameters. For example, the block temperature module 256 may determine the block temperature 252 based on a block output coolant temperature 260 (block out temp) measured by the block temperature sensor 192. The block temperature module 256 may determine the block temperature 252 using an equation or a lookup table that relates block output coolant temperatures to block temperatures. The block temperature 252 corresponds to a temperature of the metal of the block 130.

When an engine oil temperature 264 reaches a predetermined maximum engine oil temperature, the adjustment module 216, may open the second coolant valve 154 via the second coolant control module 220 such that the coolant received at the input 168 is output to at least one of the first and second heat exchangers 120 and 128 for cooling. The oil temperature 264 may be measured using the oil temperature sensor 198. Alternatively, the oil temperature 264 may be determined based on one or more other operating parameters.

When a (cylinder) wall temperature 268 of the head 108 of the engine reaches a predetermined maximum wall temperature, the adjustment module 216 provides fuel rich fueling to the engine via the fuel control module 204. For example, the adjustment module 216 may adjust the target lambda value to less than 1. For example, the adjustment module 216 may set the target lambda value to within a predetermined fuel rich range of values, such as 0.7-0.95. The adjustment module 216 may vary the target lambda value within the range, for example, based on one or more operating parameters. The fuel rich fueling may cool the engine.

The wall temperature 268 may be measured using a temperature sensor within the head 108 of the engine. Alternatively, a wall temperature module 272 may determine the wall temperature 268 based on one or more other parameters. For example, the wall temperature module 272 may determine the wall temperature 268 based on an IEM output coolant temperature 276 (IEM out temp) measured by the IEM temperature sensor 196. The wall temperature module 272 may determine the wall temperature 268 using an equation or a lookup table that relates IEM output coolant temperatures to wall temperatures. The wall temperature 268 corresponds to a temperature of the cylinder walls of the head 108.

When the target flowrate 236 falls back below a predetermined flowrate that is less than the predetermined maximum flowrate, the adjustment module 216 may discontinue adjustments and resume normal control of fueling, the first coolant valve 144, the second coolant valve 154, the block valve 138, and the coolant pump 132.

FIG. 3 is a flowchart depicting an example method of controlling fueling and coolant flow. Control begins with 304 where the target flowrate module 232 determines the target flowrate 236. At 308, the adjustment module 216 determines whether the target flowrate 236 is less than the predetermined maximum flowrate. If 308 is true, at 312 the adjustment module 216 allows normal control of fueling, the first coolant valve 144, the second coolant valve 154, the block valve 138, and the coolant pump 132. If 308 is false, control continues with 316.

At 316, based on the target flowrate 236 being equal to the predetermined maximum flowrate, the target speed module 244 sets the target speed 248 of the coolant pump 132 to a predetermined maximum speed of the coolant pump 132. The pump control module 228 controls the coolant pump 132 based on the target speed 248.

At 320, the adjustment module 216 determines whether the block temperature 252 is less than a predetermined maximum block temperature. The predetermined maximum block temperature may be calibratable and may be set based on material properties of the block 130. The predetermined maximum block temperature may be approximately 250 degrees Celsius or another suitable temperature below a temperature where the block 130 may be damaged by high temperatures. If 320 is false, the adjustment module 216 opens the block valve 138 at 324. The adjustment module 216 may open the block valve 138 to a predetermined fully open position (e.g., 100% open) or to another predetermined position. If 320 is true, control continues with 328.

At 328, the adjustment module 216 determines whether the oil temperature 264 is less than a predetermined maximum oil temperature. The predetermined maximum oil temperature may be calibratable and may be set to, for example, approximately 120 degrees Celsius or another suitable temperature. If 328 is false, the adjustment module 216 positions the second coolant valve 154 such that coolant from the input 168 flows to at least one of the first heat exchanger 120 and the second heat exchanger 128 for cooling at 332. If 328 is true, control continues with 336.

At 336, the adjustment module 216 determines whether the wall temperature 268 is less than a predetermined maximum wall temperature. The predetermined maximum wall temperature may be calibratable and may be set to, for example, approximately 250 to 300 degrees Celsius or another suitable temperature. If 336 is false, the adjustment module 216 adjusts fueling of the engine such that an air/fuel mixture within cylinders of the engine is fuel rich (lambda <1.0) at 340. If 336 is true, control continues with 344. In this manner, fuel rich fueling of the engine is only performed after the block valve 138 is opened and cooling is performed via the second coolant valve 154 to at least one of the first and second heat exchangers 120 and 128.

At 344, the target flowrate module 232 determines the target flowrate 236. At 348, the adjustment module 216 determines whether the target flowrate 236 is less than a predetermined flowrate that is less than the predetermined maximum flowrate. If 344 is true, the adjustment module 216 stops adjusting the opening of the block valve 138, the second coolant valve 154, and fueling, and resumes normal control of fueling, opening of the block valve 324, and opening of the second coolant valve 154. If 348 is false, control returns to 316 to maintain the opening of the block valve 138, the positioning of the second coolant valve 154 to provide coolant from the input 168 to at least one of the first and second heat exchangers 120 and 128, and the fuel rich fueling of the engine.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. An engine control system for an engine, comprising:

a pump control module configured to control application of power to an electric coolant pump based on a target speed;

a block control module configured to control opening of a block valve, wherein the block valve is configured to block coolant flow through a block portion of the engine when the block valve is closed and to allow coolant flow through the block portion of the engine when the block valve is open;

a fuel control module configured to control fueling of the engine;

a coolant control module configured to control a position of a coolant valve, wherein the coolant valve has a first input that receives coolant after the coolant flows through the engine, a second input that receives coolant directly from the electric coolant pump, and an output that is connected to at least one of an engine oil heat exchanger and a transmission oil heat exchanger; and an adjustment module configured to, in response to the target speed of the electric coolant pump being set to a predetermined maximum speed, the block valve being open and the coolant valve being positioned such that the second input is connected to the output, adjust the fueling of the engine such that fueling of the engine is fuel rich.

2. The engine control system of claim 1 wherein the adjustment module is configured to open the block valve after the target speed is set to the predetermined maximum speed when a temperature of the block portion of the engine is one of greater than and equal to a predetermined maximum block temperature.

3. The engine control system of claim 2 wherein the adjustment module is configured to position the coolant valve such that the second input is connected to the output after the block valve is open when an engine oil temperature is one of greater than and equal to a predetermined maximum oil temperature.

4. The engine control system of claim 3 wherein the adjustment module is configured to adjust the fueling of the engine such that fueling of the engine is fuel rich after the coolant valve is positioned such that the second input is connected to the output when a temperature of cylinder walls of the engine is one of greater than and equal to a predetermined maximum wall temperature.

5. The engine control system of claim 4 further comprising a block temperature module configured to determine the temperature of the block portion of the engine based a temperature of coolant output from the block portion of the engine.

6. The engine control system of claim 4 further comprising a temperature sensor configured to measure the engine oil temperature.

7. The engine control system of claim 4 further comprising a wall temperature module configured to determine the temperature of the cylinder walls of the engine based on a temperature of coolant output from a head portion of the engine.

8. The engine control system of claim 1 wherein;

the fuel control module is configured to control the fueling of the engine based on a target lambda value; and the adjustment module is configured to adjust the target lambda value to less than 1.0 after the target speed of the electric coolant pump is set to the predetermined maximum speed, the block valve is open, and the coolant valve is positioned such that the second input is connected to the output.

9. The engine control system of claim 1 wherein the output of the coolant valve is connected to both of the engine oil heat exchanger and the transmission oil heat exchanger.

10. The engine control system of claim 1 wherein the first input of the coolant valve receives coolant output from the block portion of the engine.

11. The engine control system of claim 1 wherein the first input of the coolant valve receives coolant output from a head portion of the engine.

12. The engine control system of claim 1 wherein the first input of the coolant valve receives coolant output from an integrated exhaust manifold of the engine.

13. The engine control system of claim 1 wherein the first input of the coolant valve receives coolant output from a turbine of a turbocharger of the engine.

14. The engine control system of claim 1 wherein the electric coolant pump is configured to output coolant to:

the block portion of the engine;

a head portion of the engine;

an integrated exhaust manifold of the engine; and a turbine of a turbocharger of the engine.

15. An engine control method for an engine, comprising:

controlling application of power to an electric coolant pump based on a target speed;

controlling opening of a block valve, wherein the block valve is configured to block coolant flow through a block portion of the engine when the block valve is closed and to allow coolant flow through the block portion of the engine when the block valve is open;

controlling fueling of the engine;

controlling a position of a coolant valve, wherein the coolant valve has a first input that receives coolant after the coolant flows through the engine, a second input that receives coolant directly from the electric coolant pump, and an output that is connected to at least one of an engine oil heat exchanger and a transmission oil heat exchanger; and in response to the target speed of the electric coolant pump being set to a predetermined maximum speed, the block valve being open, and the coolant valve being positioned such that the second input is connected to the output, adjusting the fueling of the engine such that fueling of the engine is fuel rich.

16. The engine control method of claim 15 further comprising opening the block valve after the target speed is set to the predetermined maximum speed when a temperature of the block portion of the engine is one of greater than and equal to a predetermined maximum block temperature.

17. The engine control method of claim 16 further comprising positioning the coolant valve such that the second input is connected to the output after the block valve is open when an engine oil temperature is one of greater than and equal to a predetermined maximum oil temperature.

18. The engine control method of claim 17 wherein the adjusting the fueling comprises adjusting the fueling of the engine such that fueling of the engine is fuel rich after the coolant valve is positioned such that the second input is connected to the output when a temperature of cylinder walls of the engine is one of greater than and equal to a predetermined maximum wall temperature.

19. The engine control method of claim 18 further comprising determining the temperature of the block portion of the engine based a temperature of coolant output from the block portion of the engine.

* * * * *